US005390807A

United States Patent [19]

Galaburda

[11] Patent Number: 5,390,807

[45] Date of Patent: Feb. 21, 1995

[54] CONTAINER FOR PHOTOGRAPHIC FILM

[76] Inventor: Nuno C. Galaburda, Conjunto Adrianopolis, Quadro A - Casa 09, Manaus/Amazonas - 69000, Brazil

[21] Appl. No.: 981,556

[22] Filed: Nov. 25, 1992

[51] Int. Cl.[6] ..... B65D 85/02

[52] U.S. Cl. ..... 220/4.24; 220/281; 206/389

[58] Field of Search ..... 206/389, 403, 408; 220/4.24, 306, 307, 260, 281, 4.21, 212.5, 635, 628; 215/305

[56] References Cited

U.S. PATENT DOCUMENTS

| | | | |
|---|---|---|---|
| 3,251,460 | 5/1966 | Edmonds | 220/4.24 |
| 4,101,030 | 7/1978 | Kroeber | 206/403 |
| 4,151,914 | 5/1979 | Blatt | 206/408 |
| 4,570,794 | 2/1986 | Capitao, Jr. | 206/408 |
| 4,826,005 | 5/1989 | Tajima et al. | 220/4.24 |
| 5,150,786 | 9/1992 | McAllister | 220/281 |

FOREIGN PATENT DOCUMENTS

| | | | |
|---|---|---|---|
| 700552 | 12/1964 | Canada | 206/403 |
| 981633 | 5/1951 | France | 220/281 |
| 2274513 | 1/1976 | France | 206/403 |
| 2461107 | 6/1976 | Germany | 220/4.24 |
| 18980 | 8/1911 | United Kingdom | 220/281 |
| 357936 | 10/1931 | United Kingdom | 220/281 |
| 477064 | 7/1975 | U.S.S.R. | 220/4.24 |

*Primary Examiner*—S. Castellano

*Attorney, Agent, or Firm*—Helfgott & Karas

[57] ABSTRACT

A container for a photographic film, fully made of expanded (polystyrene) plastic, is comprised of a box made up of two basic members of substantially prismatic, rectangular and equal shape. The basic members are provided with thick side walls and with the base wall forming a thin lateral contour rim. The free edge of each basic member is provided with a projecting rib and a recessed step laterally adjacent the rib. The rib and the step of the two basic members form complementary halves of their contours when the two basic members are placed one over another. A pair of bosses in the form of semicircular arcs formed on the interior of each basic member provide end cradles for the contents of the container.

1 Claim, 1 Drawing Sheet

CONTAINER FOR PHOTOGRAPHIC FILM

BACKGROUND OF THE INVENTION

As is known to those skilled in the art and, particularly, to those acquainted with the packaging industry in general, when a package is designed for the storage of a given product, both the need for confinement thereof and, especially, the requirement concerning the perfect protection of the chief characteristics thereof, as to state or of any other nature, must be borne in mind.

Thus, for example, a package for a photographic film, naturally, while being an enclosure for containment thereof, must also provide an efficient protective barrier against undue exposure to light or humidity, or both, thus preserving the essential characteristics for proper use of the product.

Accordingly, one type of currently known package for the referenced product is that comprised of a cylindrical tube of rigid plastic material, within which the film is disposed, being caused by a likewise plastic but flexible cover under a pressure fit, the tube thus comprised and assembled being further enclosed within an ordinary containing box of cardboard or like material.

Notwithstanding the wide use of this type of package, justifiable because of relative compliance with the requirements of the product for which it is intended, it is affected by a few restrictions and inconveniences, such as the use of different materials (rigid plastic and flexible plastic) for the manufacture thereof, each with their own particular production techniques and equipment, being obviously a burden to the cost of the product, to which may be added their relative vulnerability to temperature variations, danger of breaking due to dropping or other impact, all of which, consequently, demands special care in storing, carrying and handling.

A further and likewise usual type of package is comprised of a film wrapper, made of special paper and a special shield against direct exposure to light or moisture, or both, the special wrapper being imperviously closed, after which it is equally enclosed in a paper box, or the like.

As in the first case, this second usual type of package exhibits a few inconveniences, mainly in obtaining the special shielding paper with which the wrapper is manufactured, added, obviously, to the airtight closure thereof, which also calls for special techniques and equipment, with an extremely adverse effect on the cost of obtaining the product.

SUMMARY OF THE INVENTION

Under above circumstances and for the purpose of overcoming them, a container for photographic film has been proposed, object of the present invention, which, as a result of the extremely simple and ingenious constructive features thereof, is able to join together all the desired positive properties for the intended purpose, without being affected, however, by the inconveniences of similar traditional products.

Indeed, the container of the present invention, in addition to being extremely simple and low in cost as concerns the making thereof, provides the packaged film with perfect protection against shock, dropping and other impact, as well as against temperature variation, to which there also may be added the extreme ease provided for stacking, carrying and handling thereof, without any possibility of squashing or need for special care.

The attached drawings illustrate the present invention:

DETAILED DESCRIPTION OF THE PREFERRED EMBODIMENTS

Figure 1:
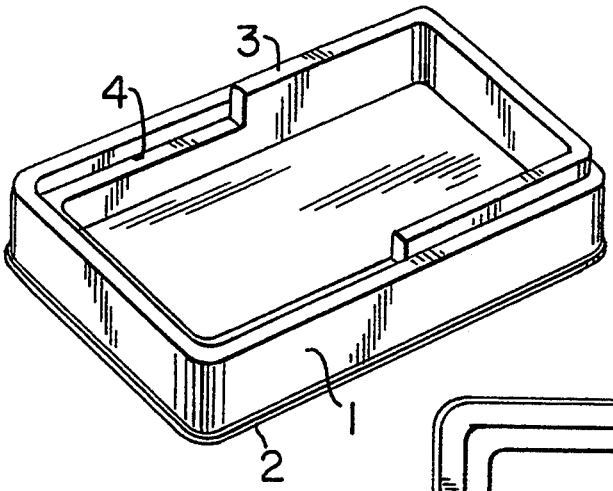
FIG. 1 a perspective view of the basic member of which the container of the present invention is comprised.
Figure 2:
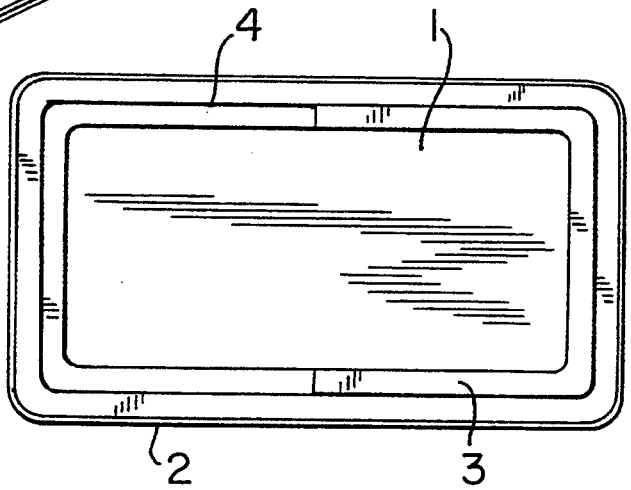
FIG. 2 is a top plan view of the same basic member of FIG. 1.
Figure 3:
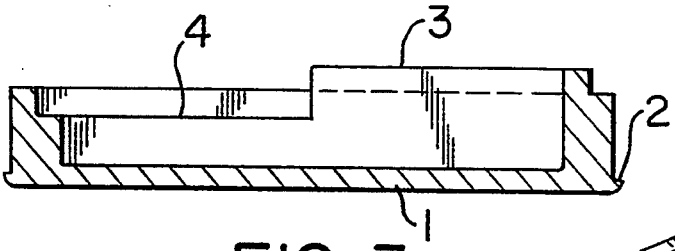
FIG. 3 is a longitudinal section of the basic member of the container.
Figure 4:
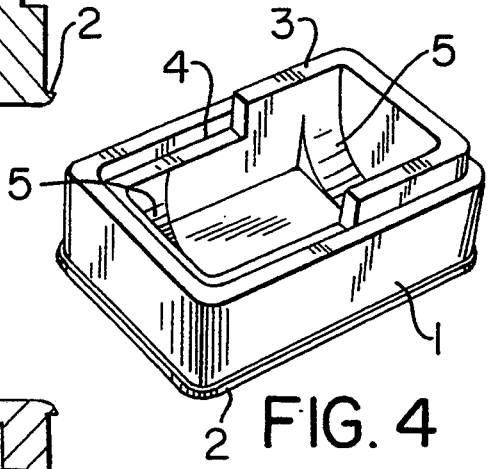
FIG. 4 is a perspective view of another embodiment of the container.

According to the aforementioned figures, the container for photographic film, subject of the present invention, is fully and preferably made of expanded (polystyrene) plastic, also commonly known as foamed plastic, plastic foam or "isopor". The container essentially comprises a box made up of two parts or basic members 1 (FIG. 1) of substantially prismatic, rectangular and equal shape, which members are provided with thick side walls, and with the base forming a thin lateral contour rim 2, extending slightly relative to the plane of the immediately adjacent lateral faces (FIG. 3), thus forming a narrow peripheral step.

In addition, at the free edge of each basic member 1 of the container, adjoining the inner faces thereof, there are provided a projecting rib 3, extending from the transverse middle of the contour thereof, and a recessed step 4, extending from the complementary half thereof, both with exactly corresponding dimensions, that is, the same heights and thicknesses, the latter being equivalent to half the thickness of the side walls of the container.

As mentioned before, the container is made up of two basic members 1, one being the base or box itself and the other functioning as a lid (FIG. 5), the latter being applied in an inverted position to the free edge of the former, so that its inner edge or projecting rib 3 fits stably into the base's inner edge or recessed step 4 and vice versa, that is, the base's inner edge rib 3 likewise fits stably into the lid's inner edge step 4.

When the subject container is assembled and closed (FIG. 5), with the stable fit of one of its parts (base or lid) into the corresponding free edge of the other, the opening operation is performed both with speed and ease, in which the user is aided by resting the fingers of both of his hands on the peripheral steps 2 of the component parts 1 thereof, which may then be at a distance from one another, to thus break the stable closing fit and thereby separate the two component members thereof.

Figure 5:
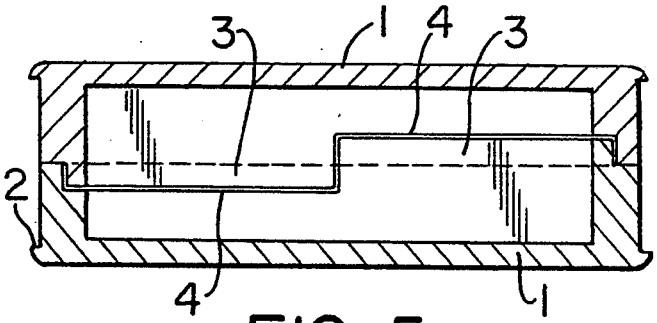
FIGS. 5 and 6 illustrate, respectively, longitudinal and cross sections of the same container when duly closed.

It is important to note that, optionally, that is, if the container is intended for the storage of a photographic film or the like, each of those basic members 1 is further provided, at extreme transverse positions of its inner bottom surface, with a pair of bosses in the form of semicircular arcs 5 (FIG. 5).

Figure 6:
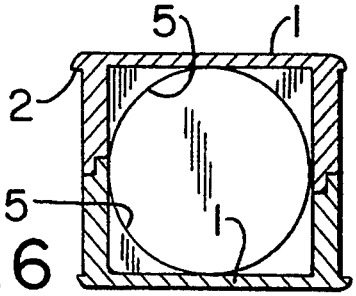

Therefore, upon compounding and assembling the container with the respective basic members 1 provided with the extreme and transverse bottom bosses 5, these become disposed (FIG. 6) so as to form circular end cradles for the extremities of the cylindrical wrapper of the film or the like.

Finally, it is important to note that, as a result of the preferred use of expanded (polystyrene) plastic for the manufacture of the container, and of its extremely simple constructive features, by the use of a single and easy-to-obtain basic member, closable by a stable fit of corresponding ribs and steps, and further including optional inner cradles to provide the contents with greater stability, the container becomes extremely practical and functional while providing absolute protection for the film or other product stored therein, against shock, dropping, thermal variations or any other accidents, and providing excellent conditions for storage, carrying and handling.

What is claimed is:

1. Container for a photographic film, comprising a box-like body fully made of polystyrene and consisting of two basic members of substantially prismatic rectangular configuration equal for said two basic members, each basic member having a base wall having a base surface, and side walls upwardly protruding from said base wall, said side walls being thicker than said base wall, said base wall including a narrow peripheral rim outwardly extending therefrom along the entire perimeter of each said member, each basic member having a free peripheral edge and including at said free peripheral edge a rib portion upwardly projecting from said side walls, and a recessed portion cut off of said side walls and adjacent said rib portion so that said rib portion and said recessed portion form two halves of said peripheral edge of the basic member, said rib portion and said recessed portion being of the same height and thickness and being of half the thickness of said side walls so that when the two basic members are placed one over another to close the container one of said basic members fits with said peripheral edge thereof over the entire peripheral edge of another of said members to form a fully closed smooth box with inner and outer faces of the side walls of the two basic members being in alignment with each other, respectively, and with two peripheral rims of said members being opposite each other for facilitating opening of the container, wherein each basic member further includes on an inner surface thereof two spaced bosses of semicircular configuration integrally molded to said basic member so that when the two basic members are in a closed position, the bosses of the two basic members form circular end cradles for the photographic film.

* * * * *